US009404234B2

(12) United States Patent
Jain

(10) Patent No.: US 9,404,234 B2
(45) Date of Patent: Aug. 2, 2016

(54) BUILDING BLOCK SYSTEM

(71) Applicant: Construction & Design Solutions, Inc., Seattle, WA (US)

(72) Inventor: Ranjiv Jain, Seattle, WA (US)

(73) Assignee: CONSTRUCTION & DESIGN SOLUTIONS, INC., Seattle, WA (US)

( * ) Notice: Subject to any disclaimer, the term of this patent is extended or adjusted under 35 U.S.C. 154(b) by 0 days.

(21) Appl. No.: 14/184,851

(22) Filed: Feb. 20, 2014

(65) Prior Publication Data

US 2014/0237922 A1 Aug. 28, 2014

Related U.S. Application Data

(60) Provisional application No. 61/769,325, filed on Feb. 26, 2013.

(51) Int. Cl.
*E02D 27/32* (2006.01)
*E04F 13/08* (2006.01)
(Continued)

(52) U.S. Cl.
CPC . *E02D 27/32* (2013.01); *E04B 2/08* (2013.01); *E04B 2/20* (2013.01); *E04B 2/22* (2013.01);
(Continued)

(58) Field of Classification Search
CPC ..... E04B 2002/0208; E04B 2/06; E04B 2/08; E04B 2002/0202; E04B 2002/0247; E04C 3/34; E04F 15/02038; E04F 15/02; E04F 15/04; E04F 2201/023; E04F 2201/0146; E04F 2201/0138; E04F 2201/0153; E04F 2201/0115; E04F 2201/043; E04F 13/0894
USPC ..... 52/592.4, 592.5, 592.6, 604, 585.1, 52/656, 285.1, 223.7, 270, 284, 286, 52/309.12, 396.08, 396.04, 436, 588.1, 52/591.1, 605, 606, 608
See application file for complete search history.

(56) References Cited

U.S. PATENT DOCUMENTS 634,562 A * 10/1899 Pagnon ..... 52/592.5
1,282,090 A * 10/1918 Lemme ..... 52/592.4
(Continued)

FOREIGN PATENT DOCUMENTS

GB 2065740 A * 7/1981 ..... E04B 2/18
WO 2004055288 A1 7/2004

OTHER PUBLICATIONS

Koto Paste, Reinforced Cement, 2 Pack Mineral Based—Koto Corp. (Sep. 28, 2011).
(Continued)

*Primary Examiner* — Robert Canfield
*Assistant Examiner* — Matthew Gitlin
(74) *Attorney, Agent, or Firm* — Panitch Schwarze Belisario & Nadel LLP

(57) ABSTRACT

A building system includes a foundation block and a wall block. Each block has opposing first and second main surfaces, a first top end and an opposing second bottom end, and opposing first and second side surfaces extending between the first and second main surfaces and between the top and bottom ends. Portions of the first and second main surfaces of the foundation block proximate the top end thereof taper axially inwardly toward each other and toward an interior of the block to form a pair of inwardly tapered surfaces. The bottom end of the wall block includes a pair of outwardly tapered surfaces which extend axially outwardly away from each other and toward an exterior of the wall block. The pair of outwardly tapered surfaces of the wall block engage the pair of inwardly tapered surfaces of the foundation block in an assembled configuration to form a first vertical stack member.

12 Claims, 8 Drawing Sheets

(51) Int. Cl.

| | |
|---|---|
| ***E04B 2/08*** | (2006.01) |
| ***E04B 2/20*** | (2006.01) |
| ***E04B 2/22*** | (2006.01) |
| ***E04C 1/39*** | (2006.01) |
| *E04B 2/02* | (2006.01) |

(52) U.S. Cl.

CPC ..... *E04C 1/395* (2013.01); *E04F 13/0894* (2013.01); *E04B 2002/0208* (2013.01); *E04F 2201/023* (2013.01)

(56) References Cited

U.S. PATENT DOCUMENTS

| | | | | | |
|---|---|---|---|---|---|
| 1,822,820 | A | * | 9/1931 | Munson | 52/436 |
| 2,001,469 | A | * | 5/1935 | Munson | 52/592.4 |
| 2,930,222 | A | * | 3/1960 | Bender | 52/286 |
| 2,942,115 | A | * | 6/1960 | O'Connell | 250/517.1 |
| 3,355,849 | A | * | 12/1967 | Hancock | 52/396.08 |
| 3,440,784 | A | * | 4/1969 | Onjukka | 52/233 |
| 4,038,798 | A | * | 8/1977 | Sachs | 52/309.7 |
| 4,272,940 | A | * | 6/1981 | Nicolls | 52/591.1 |
| 4,821,483 | A | * | 4/1989 | Adams | 52/747.12 |
| 4,833,855 | A | * | 5/1989 | Winter, IV | 52/591.4 |
| 4,907,383 | A | * | 3/1990 | Winter, IV | 52/86 |
| 5,226,276 | A | * | 7/1993 | Cahill | 52/592.6 |
| 5,381,638 | A | * | 1/1995 | Andersson | 52/592.1 |
| 5,966,896 | A | * | 10/1999 | Tylman | 52/793.1 |
| 6,253,519 | B1 | * | 7/2001 | Daniel | 52/591.1 |
| D447,819 | S | * | 9/2001 | Bilka | D25/113 |
| 6,606,835 | B1 | * | 8/2003 | Bilka | 52/604 |
| 6,735,913 | B2 | | 5/2004 | Sanders et al. | |
| 6,758,020 | B2 | | 7/2004 | Cerrato | |
| D527,467 | S | | 8/2006 | Telford | |
| 8,464,482 | B2 | * | 6/2013 | Raynor | 52/296 |
| 2004/0020144 | A1 | * | 2/2004 | Sanders et al. | 52/223.7 |
| 2005/0115185 | A1 | | 6/2005 | Telford et al. | |
| 2011/0138725 | A1 | * | 6/2011 | Bowman | 52/309.13 |

OTHER PUBLICATIONS

Koto Sand Finish, Smooth/Flat Mineral Coating System, 2 Pack Mineral Based—Koto Corp. (Sep. 28, 2011).

Koto Skimcoat, Surface Preparer, 2 Pack Mineral Based—Koto Corp. (Sep. 28, 2011).

Material Safety Data Sheet, Koto Polymer 2000—Koto Corp. (Sep. 27, 2011).

Material Safety Data Sheet, Koto Cement—Koto Corp. (Sep. 28, 2011).

Int'l Search Report and Written Opinion issued Jul. 3, 2014 in Int'l Application No. PCT/US2014/017989.

Int'l Preliminary Report on Patentability issued Sep. 11, 2015 in Int'l Application No. PCT/US2014/017989.

* cited by examiner

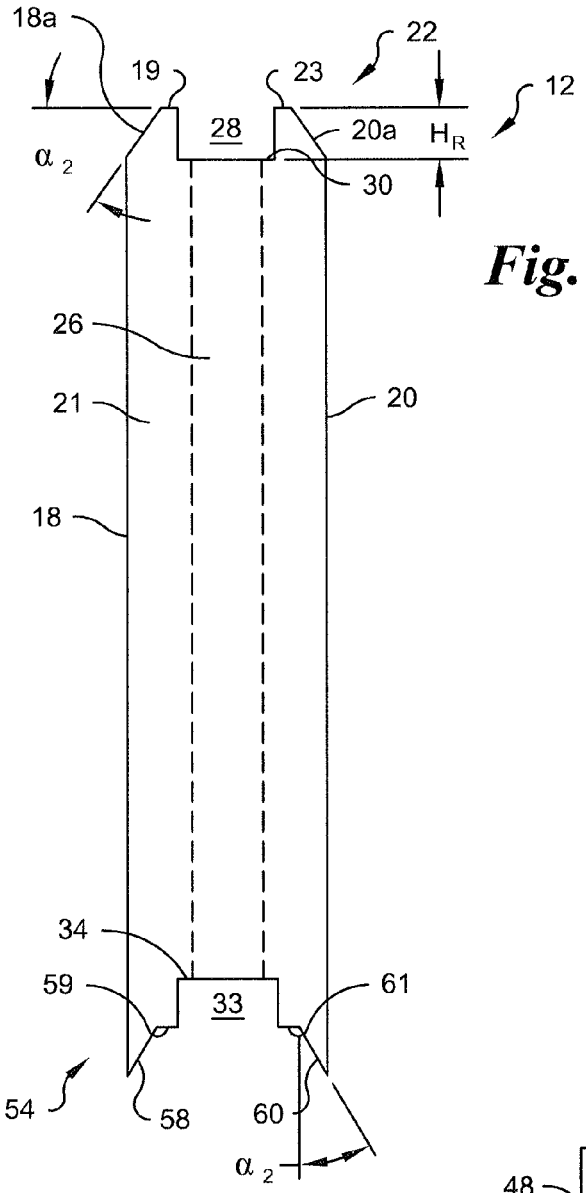
*Fig. 2*
*Fig. 3*
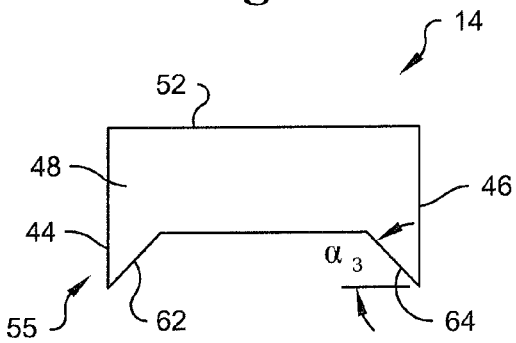

BUILDING BLOCK SYSTEM

CROSS-REFERENCE TO RELATED APPLICATIONS

This application claims priority to U.S. Provisional Patent Application No. 61/769,325, filed on Feb. 26, 2013, entitled "Building Block System," the entire contents of which are incorporated by reference herein

BACKGROUND OF THE INVENTION

The present invention relates to a building block for making a building structure, and more particularly to a system of building blocks for making a water-tight building structure.

In the construction industry, a variety of different types of building blocks and materials are utilized for building of structures. Examples of such conventional building blocks include concrete blocks and blocks of insulated concrete forms (ICFs). ICFs are interlocking modular units that are dry-stacked and then filled with concrete. ICFs thus provide for a simple concrete wall structure and offer a simplified way to build a form without the need for building any type of formwork. ICFs also do not need to be stripped down for mounting on foundations. However, ICF systems require large amounts of concrete material and are typically used only for building structures of relatively small longitudinal and latitudinal dimensions. ICF blocks have also been known to shift during building, thereby creating a wall that is not built properly. Also, highly skilled labor is generally required for building structures using ICF blocks, because a high level of knowledge of the properties of concrete is needed.

An example of a conventional building material is a structurally insulated panel (SIP). SIPs are a composite building material consisting of an insulating layer of rigid polymer foam sandwiched between two layers of structural board. SIPs combine several components of conventional building materials and can be used for many different applications, such as an exterior wall, a roof, a floor and foundation systems. However, SIPs are generally very heavy and thus large machinery is required for the handling of SIPs. Also, highly skilled labor is generally required for building structures using SIPs.

Construction blocks made of expanded polystyrene (EPS), a relatively lighter weight material, are also known in the construction industry. However, such conventional EPS blocks, when assembled together to form a structure (e.g., the exterior wall of a house), do not achieve a sufficient seal to prevent the infiltration of water through the seams between adjacent blocks. Also, the structure of conventional EPS blocks does not allow for adequate supporting of reinforcing bars, for example, around windows and doors. Another drawback of EPS building block systems is they do not allow for an adequate protective barrier, particularly for exterior walls. Specifically, conventional EPS blocks are typically coated with a concrete and fiber mesh composite, but this does not provide a surface area to which a siding material may be adhered.

Another type of conventional building system is a vertical panel system. However, vertical panel systems are complicated to install and are cumbersome to work with, such that heavy machinery is generally required to maneuver the panels. Thus, vertical panel systems can be dangerous due to the height, width and weight of the systems.

Accordingly, it would be desirable to provide a cost-effective building block system which can be assembled and installed in a simple and timely manner, but which still exhibits the high level of strength and structural integrity required for building structures, such as houses. More particularly, it would be desirable to provide a simple and cost-effective building block system which also adequately protects against water infiltration. The present invention solves these problems by utilizing different types of building blocks, each of which has a novel structure. The present invention also provides for a novel manner of assembled the building blocks together to build a structure which will be protected against water infiltration.

BRIEF SUMMARY OF THE INVENTION

In one embodiment, the present invention is directed to a building system comprising a foundation block and a wall block. Each of the foundation block and the wall block has opposing first and second main surfaces, a first top end and an opposing second bottom end, and opposing first and second side surfaces extending between the first and second main surfaces and between the top and bottom ends. Portions of the first and second main surfaces of the foundation block proximate the top end thereof taper axially inwardly toward each other and toward an interior of the foundation block to form a pair of inwardly tapered surfaces. The bottom end of the wall block includes a pair of outwardly tapered surfaces which extend axially outwardly away from each other and toward an exterior of the wall block. The pair of outwardly tapered surfaces of the wall block engage the pair of inwardly tapered surfaces of the foundation block in an assembled configuration to form a first vertical stack member.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings:

FIG. 2 is a side elevational view of a wall block according to a preferred embodiment of the present invention;

FIG. 3 is a side elevational view of a capping block according to a preferred embodiment of the present invention;

DETAILED DESCRIPTION OF THE INVENTION

Figure 1:
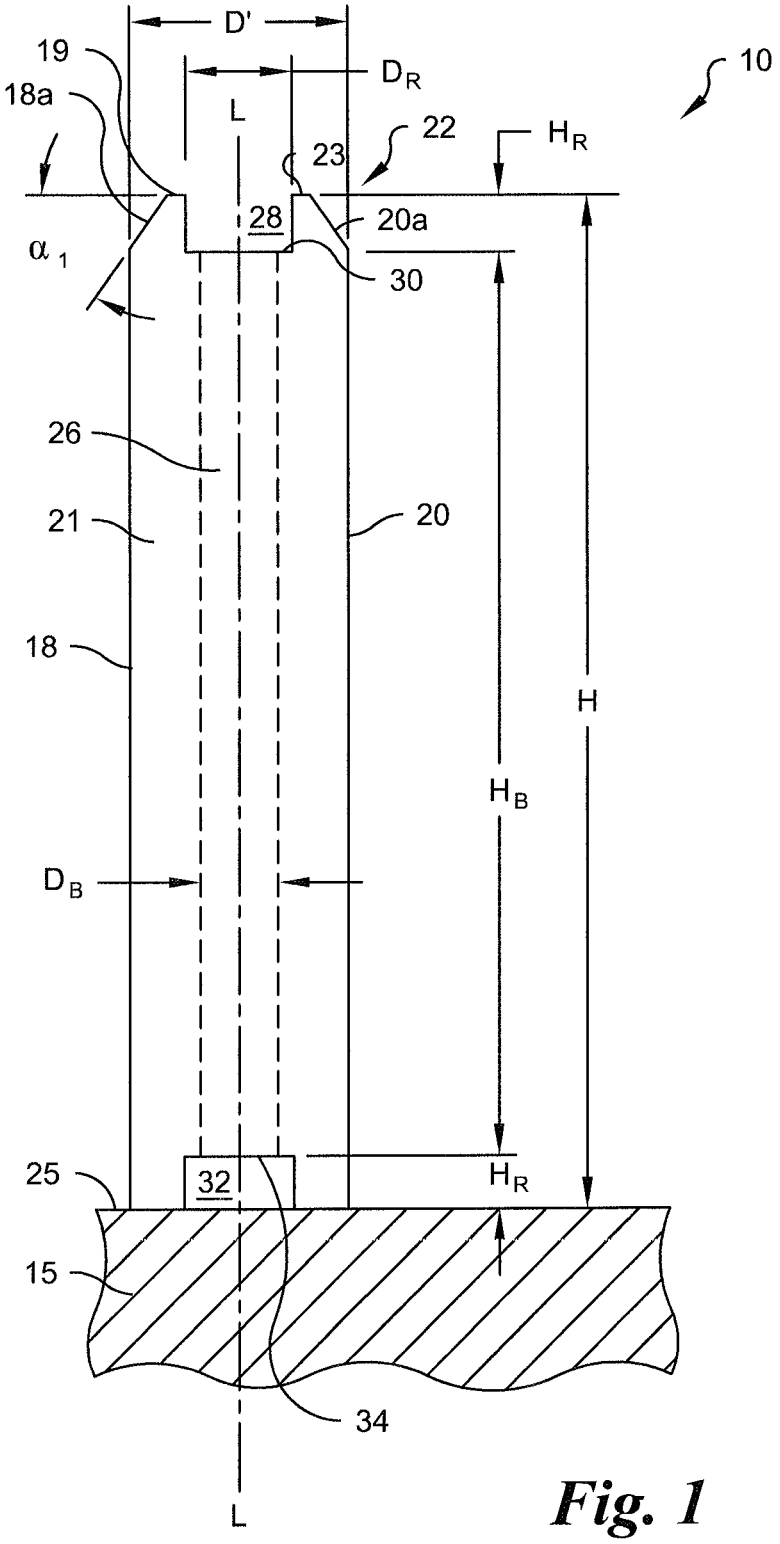
FIG. 1 is a side elevational view of a foundation block according to a preferred embodiment of the present invention.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of the system and instruments and related parts thereof. Unless specifically set forth herein, the terms "a", "an" and "the" are not limited to one element but instead should be read as meaning "at least one". The terminology includes the above-listed words, derivatives thereof and words of similar import.

Figure 4:
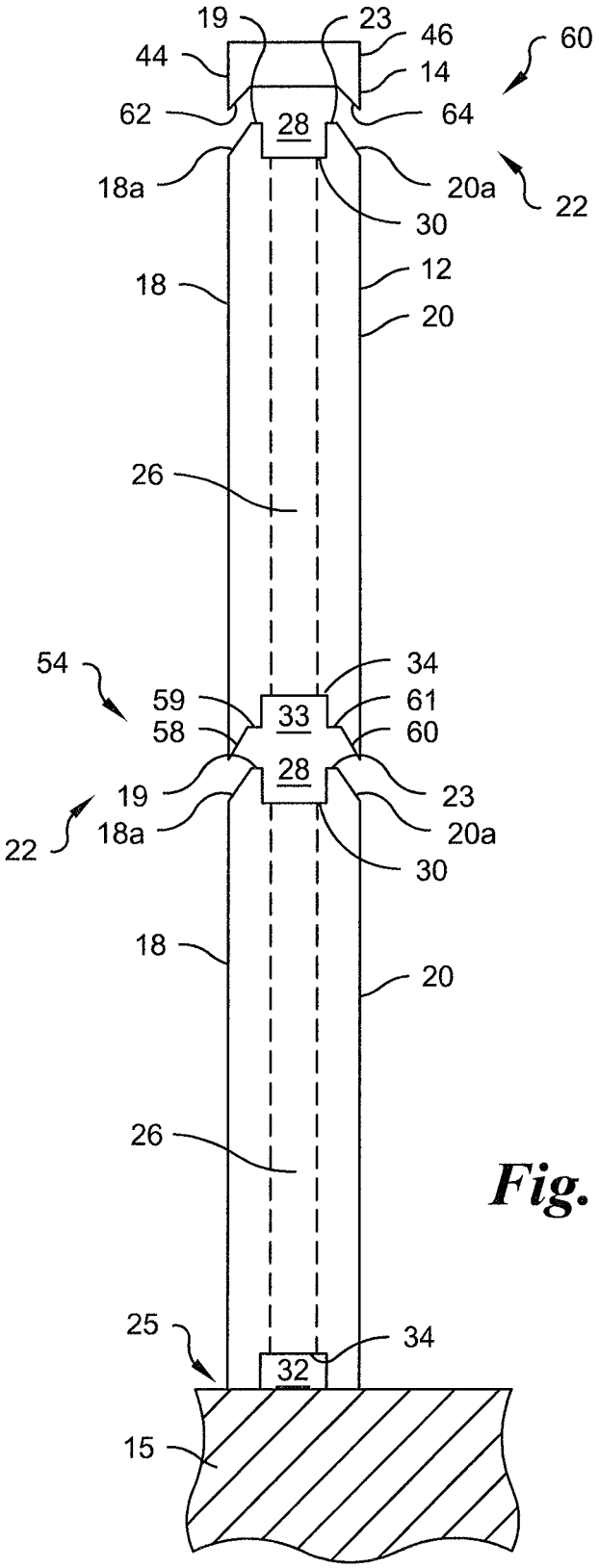
FIG. 4 is an exploded side elevational view of a vertical stacked structure according to a preferred embodiment of the present invention.
Figure 5:
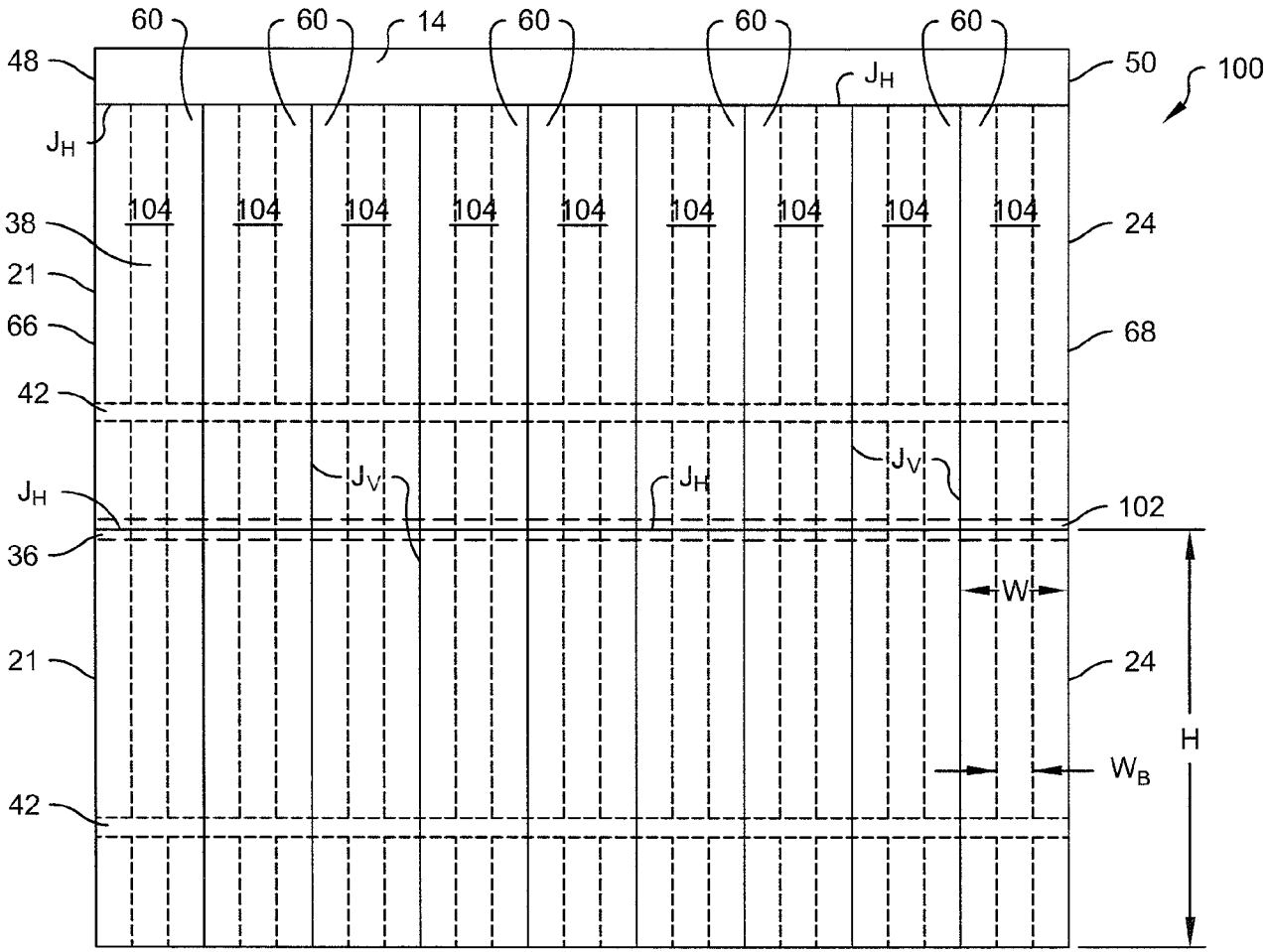
FIG. 5 is a front elevational view of a wall according to a preferred embodiment of the present invention.
Figure 9:
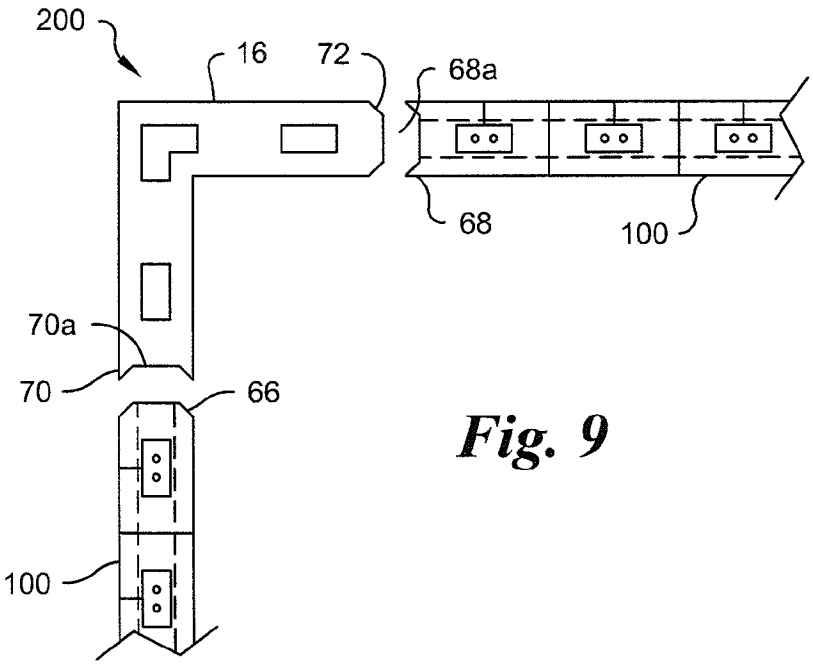
FIG. 9 is a partial exploded top plan view of a first wall block, a second wall block and a corner block according to a preferred embodiment of the present invention.

Referring to FIGS. 1-8, there are shown four different types of modular, precast building blocks, generally designated 10, 12, 14 and 16, respectively. One or more of the building blocks 10, 12, 14, 16 may be assembled together, as described in more detail herein, to form an intermediate building structure 100, such as a wall, as shown in FIG. 5. More particularly, the wall 100 is constructed of a first row of building blocks 10, also known as foundation blocks, set upon a footing or foundation 15. A second layer of building blocks 12, also known as wall blocks, is then set upon the first layer of foundation blocks 10. Additional layers of wall blocks 12 may be utilized to achieve a desired height. Finally, the third block 14, also known as a cover block, is set upon the last layer of wall blocks 12 to construct the wall 100. One or more of the walls 100 may then be assembled together, utilizing the fourth or corner block 16, to construct a completed building structure 200, such as a room of a commercial or residential dwelling, as shown in FIG. 9.

Each of the building blocks 10, 12, 14, 16 is made of a lightweight material suitable for construction. Preferably, each block 10, 12, 14, 16 is made of a material which exhibits a high thermal resistance and a high structural strength. Examples of materials for the blocks 10, 12, 14, 16 include plastic (or some other polymeric material), paperstone, bentonyte or composites thereof. More preferably, each block 10, 12, 14, 16 is made of a plastic material, such as expanded polystyrene (EPS) beads. A preferred example of an EPS material for the building blocks 10, 12, 14, 16 is Cellofoam® EPS manufactured by Cellofoam North America Inc. However, it will be understood that any EPS material may be utilized.

The resulting building blocks 10, 12, 14, 16 are each substantially light in weight, but of sufficient strength for constructing a building structure, such as exterior and interior walls, retaining walls, roofing systems, foundations and the like. It will be understood by those skilled in the art that the material of the building blocks 10, 12, 14, 16 is not limited to the described examples. Instead, as previously described, the building blocks 10, 12, 14, 16 may be made of any made of a lightweight material having sufficient strength for use as a construction material.

It will be understood by those skilled in the art that while preferred embodiments are described herein, in which the building blocks 10, 12, 14, 16 each have particular dimensions, the dimensions (e.g., height, width and depth) of the building blocks 10, 12, 14, 16 may vary as necessary depending on the building needs of different customers and end users.

Referring to FIG. 1, the first block 10 is a foundation block. More particularly, in an assembled structure, a plurality of the foundation blocks 10 may be secured to a preformed concrete footing or monolithic foundation slab 15 to form a first row or layer of foundation building blocks 10. The foundation block 10 has a first, main surface 18 and an opposing second, main surface 20. The foundation block 10 further includes a first lateral side surface (e.g. a left-hand side surface) 21 and an opposing second lateral side surface (e.g., a right-hand side surface) 24 (see FIG. 5). The first and second main surfaces 18, 20 of the foundation block 10 are preferably generally smooth planar surfaces which extend generally parallel to each other. The first and second lateral side surfaces 21, 24 preferably extend generally parallel to each other and also extend between and generally perpendicular to the first and second main surfaces 18, 20. The first and second lateral side surfaces 21, 24 also preferably have a generally smooth planar surface. As such, the foundation block 10 has a generally rectangular or square cross-sectional shape.

Referring to FIGS. 1 and 5, in one embodiment, each foundation block preferably has a height H of approximately 2 to 4 feet, and more preferably approximately 3 feet; a width W of approximately 10 to 16 feet, and more preferably approximately 12 feet; and a depth D of approximately 6 to 12 inches, and more preferably approximately 8 inches. The height H is measured in a direction of extension along a central longitudinal axis L of the foundation block 10. The width W is measured in a direction perpendicular to the height H of the foundation block 10 (i.e., into and out of the paper on FIG. 1). The depth D is measured in a direction perpendicular to both the height H and width W of the foundation block 10. More particularly, the depth D is a measure of the thickness of the foundation block 10. It will be understood that the dimensions and shape of the foundation block 10 may vary as necessary to suit the needs of different customers and building structures.

The foundation block 10 also has a first, top end 22 and an opposing second, bottom end 25. Proximate the top end 22 of the foundation block 10, at least a portion of each of the first and second main surfaces 18, 20 tapers upwardly and axially inwardly toward each other and toward an interior of the foundation block 10 to form inwardly tapered surfaces **18*a*, 20*a* (i.e., a first top end portion). More preferably, the inwardly tapered surfaces 18*a*, 20*a* extend along the entire width W of the foundation block 10. Preferably, the inwardly tapered surfaces 18*a*, 20*a* extend axially inwardly at an angle $\alpha_1$ of approximately 20° to 60°. More preferably, the inwardly tapered surfaces 18*a*, 20*a* extend axially inwardly at an angle $\alpha_1$ of approximately 60°. At the distalmost or uppermost tip of the top end 22 of the foundation block 10, the inwardly tapered surfaces 18*a*, 20*a* transition to form spaced-apart horizontally-extending planar surfaces 19, 23** (i.e., a second top end portion).

A first elongated indentation or recess 28 is formed proximate the top end 22 of the foundation block 10 between the tapered surfaces **18*a*, 20*a*, and more particularly between the spaced-apart horizontally-extending planar surfaces 19, 23. The recess 28 preferably has a generally rectangular shape in cross section and extends along at least a portion of the foundation block 10 in the direction of the width W thereof, parallel to the planar surfaces 19, 23. More preferably, the recess 28 extends along the entire width W of the foundation block 10. In one embodiment, the recess 28 preferably has a height $H_R$ of approximately 1 to 3 inches, and more preferably approximately 2 inches, measured from the top end 22 of the foundation block 10, and more particularly from the spaced-apart horizontally-extending planar surfaces 19, 23 to a first, upper recessed surface 30. The recess 28 also preferably has a thickness or depth $D_R$ of approximately 3 to 5 inches, and more preferably approximately 4 inches, measured in the direction of the depth D of the foundation block 10. However, it will be understood that the dimensions and shape of the recess 28** may vary as necessary to suit the needs of different customers and building structures.

A second elongated indentation or recess 32 is preferably also formed proximate the bottom end 25 of the foundation block 10. The second recess 32 preferably has a generally rectangular shape in cross section and extends from the bottom end 25 of the foundation block 10 to a second, lower recessed surface 34 opposite the first recessed surface 30. The dimensions (e.g., width, height and depth) of the second recess 30 are preferably the same or as at least substantially similar to those of the first recess 28. The second recess 32 preferably serves as a groove 32 for engaging a corresponding protrusion, and more particularly for fixedly engaging a preformed or cast concrete protrusion or tongue of the footing or foundation 15. More particularly, when the foundation block 10 is mounted on the concrete footing or monolithic foundation slab 15, the concrete material of the footing or foundation slab substantially or entirely fills the second recess 32 to secure the foundation block 10 to the footing or foundation 15. In one embodiment, the bottom end 25 of the foundation block 10 and more particularly the area of the second recess 32 is coated with a structural adhesive or epoxy which helps create a water-tight seal between the foundation block 10 and the footing/foundation 15 (i.e., at the cold joint), thereby reducing the risk of water infiltration at the cold joint.

A longitudinal opening or bore 26 is preferably formed within the body of the foundation block 10 proximate the central longitudinal axis L of the foundation block 10 in a direction parallel to the height H thereof. More particularly, the bore 26 extends in the direction of the central longitudinal axis L and the height H of the foundation block 10 from the top end 22 to the bottom end 25, and more preferably from the first, upper recessed surface 30 to the second, lower recessed surface 34. Accordingly, the height $H_B$ of the bore 26 is preferably the same as the height H of the foundation block 10 minus the heights $H_R$ of the first and second recesses 28, 32. For example, in a preferred embodiment, where the first and second recesses 28, 32 each have a height $H_R$ of approximately 2 inches and the foundation block 10 has an overall height H of approximately 3 feet, the bore 26 has a height $H_B$ of approximately 32 inches. However, it will be understood that the height $H_R$ of the bore 26 may vary, as the heights of the foundation block 10 and recesses 28, 32 vary to meet particular customer needs.

Similarly, the other dimensions (e.g., width $W_B$ and depth $D_B$) of the bore 26 may vary to meet the building needs of different customers or end users. Preferably, however, the bore 26 has a depth $D_B$ of approximately 3 to 5 inches, and more preferably approximately 4 inches. The bore 26 also preferably has a width $W_B$ of approximately 4 to 8 inches, and more preferably approximately 6 inches. Further, when various foundation blocks 10 are horizontally arranged in a line for building of a wall 100, the distance between the geometric center of the bore 26 of a first foundation block 10 to the geometric center of the bore 26 of a second foundation block 10, situated directly adjacent to the first foundation block 10, is preferably approximately 10 to 20 inches and most preferably approximately 16 inches. However, it will be understood that size of the bore 26 and the block 10 may vary to meet particular engineering and building needs.

The foundation block 10 is suited for various types of building uses, including for building of exterior walls, interior walls, retaining walls, zero lot line developments similar to using a soldier pile system, a pin piling system for walls, and the like. For building such structures, a first row or layer of one or more foundation blocks 10 is secured to a footing or foundation, as described above.

Referring to FIG. 2, the second block 12 is a wall block. Most of the structure and dimensions of the wall block 12 are similar to that of the foundation block 10, and thus like numerals have been used for like structural elements and dimensions. Accordingly, a complete description of the structure of the wall block 12 has been omitted, with only the differences being described using different numerals.

In particular, while the top ends 22 of the wall block 12 and foundation block 10 are the same or at least substantially similar, the wall block 12 has a bottom end 54 which differs from the bottom end 25 of the foundation block 10. Specifically, the bottom end 54 of the wall block 12 includes a pair of outwardly tapered surfaces 58, 60 (i.e., a first bottom end portion) and a pair of spaced-apart horizontally-extending planar surfaces 59, 61 (i.e., a second bottom end portion). More particularly, at the bottom end 54 of the wall block 12, the outwardly tapered surfaces 58, 60 taper downwardly from the spaced-apart horizontally-extending planar surfaces 59, 61 and extend axially outwardly away from each other and toward an exterior of the wall block 12. More preferably, the outwardly tapered surfaces 58, 60 extend along the entire width W of the wall block 12. Preferably, the outwardly tapered surfaces 58, 60 extend axially outwardly at an angle $\alpha_2$ of approximately 20° to 60°. More preferably, the outwardly tapered surfaces 58, 60 extend axially outwardly at an angle $\alpha_2$ of approximately 60°.

Referring to FIG. 4, each wall block 12 is preferably configured to be positioned on the top end 22 of a foundation block 10. Accordingly, most preferably, the angle $\alpha_2$ of taper of the outwardly tapered surfaces 58, 60 at the bottom end 54 of the wall block 12 is the same as or at least substantially similar to the angle $\alpha_1$ of taper at the top end 22 of the foundation block 10, such that the bottom end 54 of the wall block 12 mates or otherwise couples with the top end 22 of the foundation block 10.

More particularly, referring to FIG. 5, each intermediate building structure or wall 100 is formed by one or more vertical stack members 60, each of which is comprised of at least a first wall block 12 positioned on top of a foundation block 10. In each vertical stack member 60, the outwardly tapered surfaces 58, 60 of the bottom end 54 of the first wall block 12 directly engage and sit flush with the corresponding inwardly tapered surfaces 18*a*, 20*a* of the top end 22 of the foundation block 10 at a first horizontal joint $J_H$. Also, the horizontally extending planar surfaces 59, 61 of the bottom end 54 of the first wall block 12 directly engage and sit flush with the corresponding horizontally extending planar surfaces 19, 23 of the top end 22 of the foundation block 10.

Preferably, each vertical stack member 60 further includes a second wall block 12 positioned on top of the first wall block 12, such that the outwardly tapered surfaces 58, 60 and horizontally extending planar surfaces 59, 61 of the bottom end 54 of the second wall block 12 directly engage and sit flush with the corresponding inwardly tapered surfaces 18*a*, 20*a* and horizontally extending planar surfaces 19, 23 of the top end 22 of the first wall block 12 at a second horizontal joint $J_H$. It will be understood that each vertical stack member 60 may further include a third wall block 12, a fourth wall block 12, and so forth, until the desired height of the vertical stack member 60 is achieved.

A second elongated indentation or recess 33 is formed proximate the bottom end 54 of the wall block 12 between the outwardly tapered surfaces 58, 60. The dimensions of the recess 33 are preferably similar to the dimensions of the first recess 28 at the top end 22 of the wall block 12, with the height $H_R$ of the second recess 33 being measured from the innermost edges of the outwardly tapered surfaces 58, 60 to the second, lower recessed surface 34.

Additionally, at the first horizontal joint $J_H$ of each vertical stack member 60, the position of the second elongated recess 33 of the first wall block 12 preferably corresponds or matches up with that of the first elongated recess 28 of the foundation block 10. Similarly, at the second horizontal joint $J_H$, the position of the second elongated recess 33 of the second wall block 12 preferably corresponds or matches up with that of the first elongated recess 28 of the first wall block 12. Accordingly, in each vertical stack member 60, a horizontally-extending opening or cavity 36 is preferably formed at each horizontal joint $J_H$ in the direction of the width W of the foundation and wall blocks 10, 12 (i.e., perpendicular to the central longitudinal axes L thereof). The dimensions of each cavity 36 are determined by the dimensions of the mated recesses 28 and 33. For example, in one embodiment, in which the height $H_R$ of each recess 28, 33 is preferably approximately 2 inches, the overall height $H_C$ of each horizontally-extending cavity 36 is 4 inches.

Further, in each vertical stack member 60, the positions of the vertically-extending bores 26 of the wall block(s) 12 and the foundation block 10 preferably correspond to or match up with each other, thereby forming a vertically-extending opening or cavity 38 through the vertically stacked building blocks 10, 12 in the direction of the height H thereof (i.e., parallel to and proximate the central longitudinal axes L thereof).

In one embodiment, the intermediate building structure (i.e., the wall) 100 is preferably formed of at least two vertical stack members 60 positioned laterally adjoining or adjacent each other (see FIG. 5). More particularly, the vertical stack members 60 are preferably laterally arranged, such that the positions of each horizontal joint $J_H$ of each vertical stack member 60, and thus the horizontally-extending cavities 36 of each vertical stack member 60, correspond to or match up with each other. Accordingly, the wall 100 preferably includes at least one horizontally-extending channel 102, formed by the plurality of corresponding horizontally-extending cavities 36, at the position of each of the horizontal joints $J_H$. Similarly, the wall 100 preferably includes at least one vertically-extending channel 104 formed by the plurality of corresponding vertically-extending cavities 38 in each vertical stack member 60.

The horizontally-extending channels 102 and the vertically-extending channels 104 are each configured to receive one or more structural bond beams 40 (FIGS. 6-7), such as reinforcing rods, rebars, reinforcing cylinders, and the like, therein. The reinforcing rods 40 are preferably constructed of a high strength metal, such as steel. The reinforcing rods 40 which run through the horizontally-extending channels 102 preferably tie into each vertical stack member 60 and across each wall or foundation block 10, 12 to create monolithic beams for purposes of enhancing the structural integrity of the wall structure 100 in the lateral plane.

The reinforcing rods 40 which run through the vertically-extending channels 104, perpendicular to the reinforcing rods 40 running through the horizontally-extending channels 102, preferably tie into the wall or foundation block 10, 12 of each vertical stack member 60 to create monolithic beams for purposes of enhancing the structural integrity of the wall structure 100 in the longitudinal plane. The vertically-extending reinforcing rods 40 also preferably tie into the roof and foundation/footing, such that each foundation block 10 is secured to the footing/foundation by not only concrete, but also by one or more reinforcing rods 40. Preferably, each of the horizontally-extending channels 102 and vertically-extending channels 104 is also substantially, and more preferably, entirely reinforced or filled with concrete for providing additional structural support to the wall 100. The resulting wall 100 thus has superior structural integrity and is structurally integrated on all planes and axes.

Figure 11:
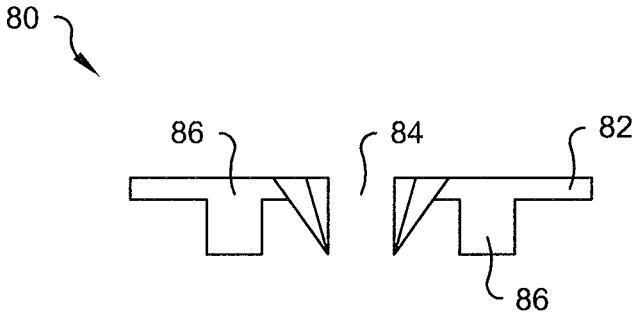
FIG. 11 is a cross-sectional view of a clip according to a preferred embodiment of the present invention.

In one embodiment, a clip 80 is utilized to facilitate proper positioning and placement of the reinforcing rods 40 (see FIG. 11). The clip 80 includes a main body 82, a central cylindrical or conically-shaped opening 84, and first and second protrusions 86 extending from the main body 82. The clip 80 is of a size and shape to be received within the horizontally-extending channels 102 and vertically-extending channels 104. For positioning of a reinforcing rod 40, a clip 80 is placed within the horizontally-extending channel 102 or vertically-extending channel 104, such that the cylindrical opening 84 aligns with the desired position of the reinforcing rod 40. Then, the reinforcing rod 40 can be inserted through the horizontally-extending channel 102 or vertically-extending channel 104 and the clip 80 positioned therein. In addition, the clips 80 are stackable, such that two or more clips 80 may be utilized within a single horizontally-extending channel 102 or vertically-extending channel 104. For example, a first clip 80 may be utilized in the position shown in FIG. 11. Then, a second clip 80 may be utilized in a position that is inverted to that shown in FIG. 11, such that two stacked clips 80 are positioned in a single horizontally-extending channel 102 or vertically-extending channel 104.

In one embodiment, each of the wall blocks 12 and foundation blocks 10 also preferably includes at least one internal conduit 42 extending horizontally therethrough in a direction of the width W of each block 10, 12, perpendicular to the height H and central longitudinal axis L of each block 10, 12 (see FIG. 5). The conduits 42 are not shown in FIGS. 1-2 for clarity of the remaining elements the blocks 10, 12. More preferably, each block 10, 12 includes a horizontally-extending conduit 42 at a position 12 inches above the respective bottom end 25, 54 thereof, such that the conduits 42 are perfectly suited for receiving electrical wiring, piping and other such utilities. The conduits 42 are preferably substantially or entirely filled with a grout material which creates a thermal mass in the building structure, thereby enhancing the R-Value of the building structure.

To complete the wall 100, the third building block 14 (shown in FIG. 3) is utilized. The third building block 14 preferably functions as a cover or capping block 14 to cover the assembled vertical stack members 60 of foundation and wall blocks 10, 12. The capping block 14 preferably has a first, main surface 44 and an opposing second, main surface 46. The capping block 14 preferably further includes a first lateral side surface (e.g. a left-hand side surface) 48 and an opposing second lateral side surface (e.g., a right-hand side surface) 50 (FIG. 5). The first and second main surfaces 44, 46 of the capping block 14 are preferably generally smooth planar surfaces which extend parallel to each other. Each of the first and second lateral side surfaces 48, 50 preferably extend parallel to each other and also preferably extend between and perpendicular to the first and second main surfaces 44, 46. The first and second lateral side surfaces 48, 50 also have a generally smooth planar surface.

The capping block 14 also has a first, top end 52 and an opposing second, bottom end 55. The bottom end 55 of the capping block 14 includes a pair of outwardly tapered surfaces 62, 64. More particularly, at the bottom end 55 of the capping block 14, the outwardly tapered surfaces 62, 64 taper downwardly from an interior area of the capping block 14 and extend axially outwardly away from each other and toward an exterior of the capping block 14. More preferably, the outwardly tapered surfaces 62, 64 extend axially outwardly away from each other at an angle $\alpha_3$ of approximately 35° to 60°. More preferably, the outwardly tapered surfaces 62, 64 extend at an angle $\alpha_3$ of approximately 45°. Most preferably, the angle $\alpha_3$ of taper of the outwardly tapered surfaces 62, 64 at the bottom end 55 of the capping block 14 is the same as or at least substantially similar to the angle $\alpha_2$ of taper at the top end 22 of each wall block 12, such that the bottom end 55 of the capping block 14 is configured to mate or otherwise couple with the top end 22 of each wall block 12.

More particularly, as described above and as shown in FIGS. 4-5, the wall 100 includes one or more vertical stack members 60. For each vertical stack member 60, a wall block 12, and more particularly the top end 22 of the last wall block 12 layer will remain exposed. The capping block 14 is utilized to cover the exposed top ends 22 of each of the uppermost wall blocks 12. Thus, as the capping block 14 is positioned on top of a plurality of assembled vertical stack members 60, the outwardly tapered surfaces 62, 64 of the bottom end 54 of the capping block 14 preferably directly engages and sits flush with the corresponding inwardly tapered surfaces 18*a*, 20*a* of the exposed top end 22 of the last wall block 12 of each vertical stack member 60.

Figure 6:
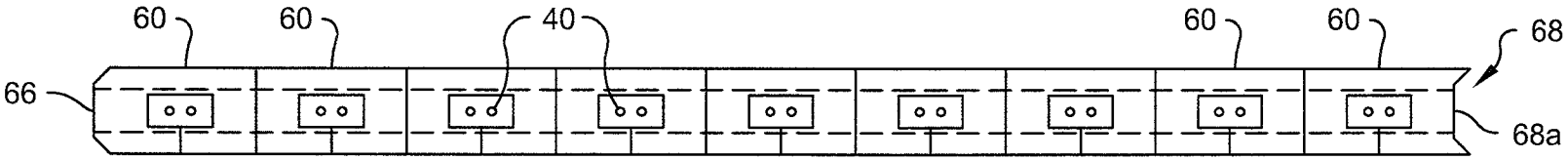
FIG. 6 is a top plan view of a wall according to a preferred embodiment of the present invention.
Figure 7:
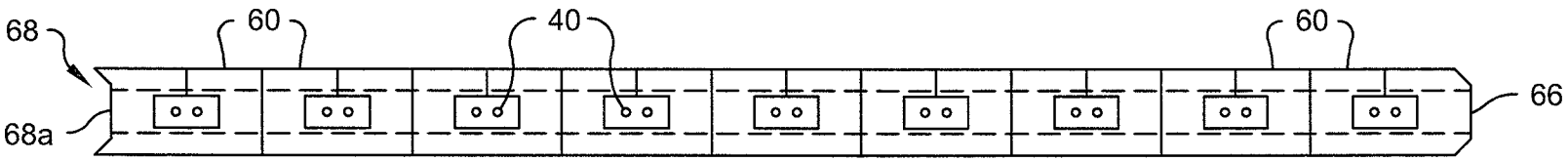
FIG. 7 is another top plan view of a wall according to a preferred embodiment of the present invention.

Referring to FIGS. 6-7, the building blocks 10, 12, 14 which make up the distalmost vertical stack members 60, and more particularly the left-most and the right-most vertical stack members 60, have structures that vary slightly from the building blocks 10, 12, 14 which make up the center vertical stack members 60. Specifically, the exposed first lateral side surface 66 of the wall 100, which is formed of the first lateral surfaces 21 of the foundation block 10 and wall block(s) 12 of the left-most vertical stack member 60, preferably has a generally curved or outwardly tapered shape. The exposed opposing second lateral side surface 68 of the wall 100, which is formed of the second lateral surfaces 24 of the foundation block 10 and wall block(s) 12 of the right-most vertical stack member 60, preferably includes a recess 68*a* of a generally curved or inwardly tapered shape. It will be understood that the wall 100 may have the alternate configuration, in which the exposed lateral surfaces 66 of the left-most vertical stack member 60 includes a generally curved or inwardly tapered recess and the exposed lateral surface 68 of the right-most vertical stack member 60 has a generally curved or outwardly tapered shape.

Each of the horizontal joints $J_H$ of each vertical stack member 60 is preferably provided with a structural or construction adhesive or epoxy to facilitate a secure and water-tight joint and seal between the foundation block 10 and the first wall block 12 mounted thereon, between the wall blocks 12 mounted to each other, and between the last wall block 12 and the capping block 14, to reduce or preferably eliminate water infiltration at the horizontal joints. Preferably, the adhesive is coated on at least the inwardly and outwardly tapered surfaces 18*a*, 20*a*, 58, 60, 62, 64 of the foundation, wall and capping blocks 10, 12, 14. In one embodiment, the adhesive is preferably one of the construction adhesives manufactured by Loctite® or an adhesive having sealing and adherence properties substantially similar thereto.

A structural or construction adhesive or epoxy is also preferably provided at each of the vertical joints $J_V$ between laterally adjoining or adjacent vertical stack members 60 to facilitate a secure and water-tight joint and seal between the stack members 60 and reduce or preferably eliminate water infiltration at the vertical joints. In one embodiment, the adhesive is preferably one of the construction adhesives manufactured by Ashland® Inc. or an adhesive having sealing and adherence properties substantially similar thereto.

The above-described structural/construction adhesives provide both lateral and compressive structural properties for the building blocks. Also, in situations where grout is used to seal the building structure, the adhesives prevents expansion or explosion of the building blocks due to pressure build-up created by the grout.

Figure 8:
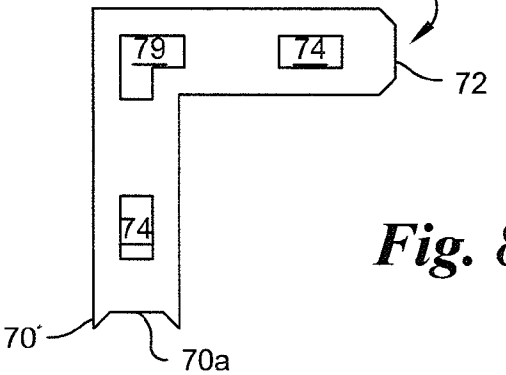
FIG. 8 is a top plan view of a corner block according to a preferred embodiment of the present invention.

A fully assembled intermediate building structure 200, such as a room of a commercial or residential dwelling, is shown in FIG. 9. Referring to FIGS. 8-9, to form the completed building structure, one or more intermediate building structures (i.e., walls) 100 are assembled together using the fourth building block 16. The fourth building block 16 is a corner block. The corner block 16 has a generally L-shaped cross-section, with a first lateral end 70 and a second lateral end 72. The first end 70 of the corner block 16 preferably includes a recess 70*a* of a generally curved or inwardly tapered shape. The second end 72 of the corner block 16 preferably has a generally curved or outwardly tapered shape. More preferably, the recess 70*a* of the first end 70 of the corner block 16 has a shape that corresponds to or matches up with the shape of the exposed first lateral side surface 66 of the wall 100 and the second end 72 of the corner block 16 has a shape that corresponds to or matches up with the shape of the recess 68*a* of the exposed second lateral side surface 68 of the wall 100. The corner block 16 also preferably includes one or more openings 74 vertically extending therethrough for receiving one or more reinforcing rods 40 and/or reinforcing concrete. The corner opening 79 is preferably an L-shaped opening.

It will be understood that the corner blocks 16 are configured to be stacked similar to the foundation and wall blocks 10, 12. Accordingly, the corner blocks 16 which may be mounted on the footing or foundation 15 preferably have first, top ends configured similar to the first top end 22 of the foundation block 10 and opposing second, bottom ends similar to the second bottom end 25 of the foundation block 10. Similarly, the corner blocks 16 which may then be stacked or otherwise mounted upon the foundation corner block 16, adjacent the wall blocks 12, preferably have first, top ends configured similar to the first top end 22 of the wall block 12 and opposing second, bottom ends similar to the second bottom end 54 of the wall block 12.

To assemble a first wall 100 with a second wall 100, the first lateral side surface 66 of the first wall 100 is positioned such that it is received within the recesses 70*a* of the first ends 70 of the stacked corner blocks 16 and the second ends 72 of the stacked corner blocks 16 are positioned such that they are received within the recess 68*a* of the second lateral side surface 68 of the second wall 100. Preferably, the first lateral side surface 66 of the first wall 100 sits flush with the recesses 70*a* of the first ends 70 of the stacked corner blocks 16 and the second ends 72 of the stacked corner blocks 16 sit flush with the recess 68*a* of the second lateral side surface 68 of the second wall 100.

A structural or construction adhesive or epoxy is preferably provided at each of the vertical joints $J_V$ between the first lateral side surface 66 of the first wall 100 and the recess 70*a* of the corner block 16 and between the second end 72 of the corner block 16 and the recess 68*a* of the second lateral side surface 68 of the second wall 100, in order to facilitate secure and water-tight joints and reduce or preferably eliminate water infiltration at these joints. Preferably, the adhesive is provided only on untapered or non-curved portions of the first lateral side surface 66, the recess 70*a*, the second end 72, and/or the recess 68*a*. However, it will be understood that the entirety of these components may be coated with the adhesive. In one embodiment, the adhesive is preferably one of the construction adhesives manufactured by Ashland® Inc. or an adhesive having sealing and adherence properties substantially similar thereto.

Figure 10:
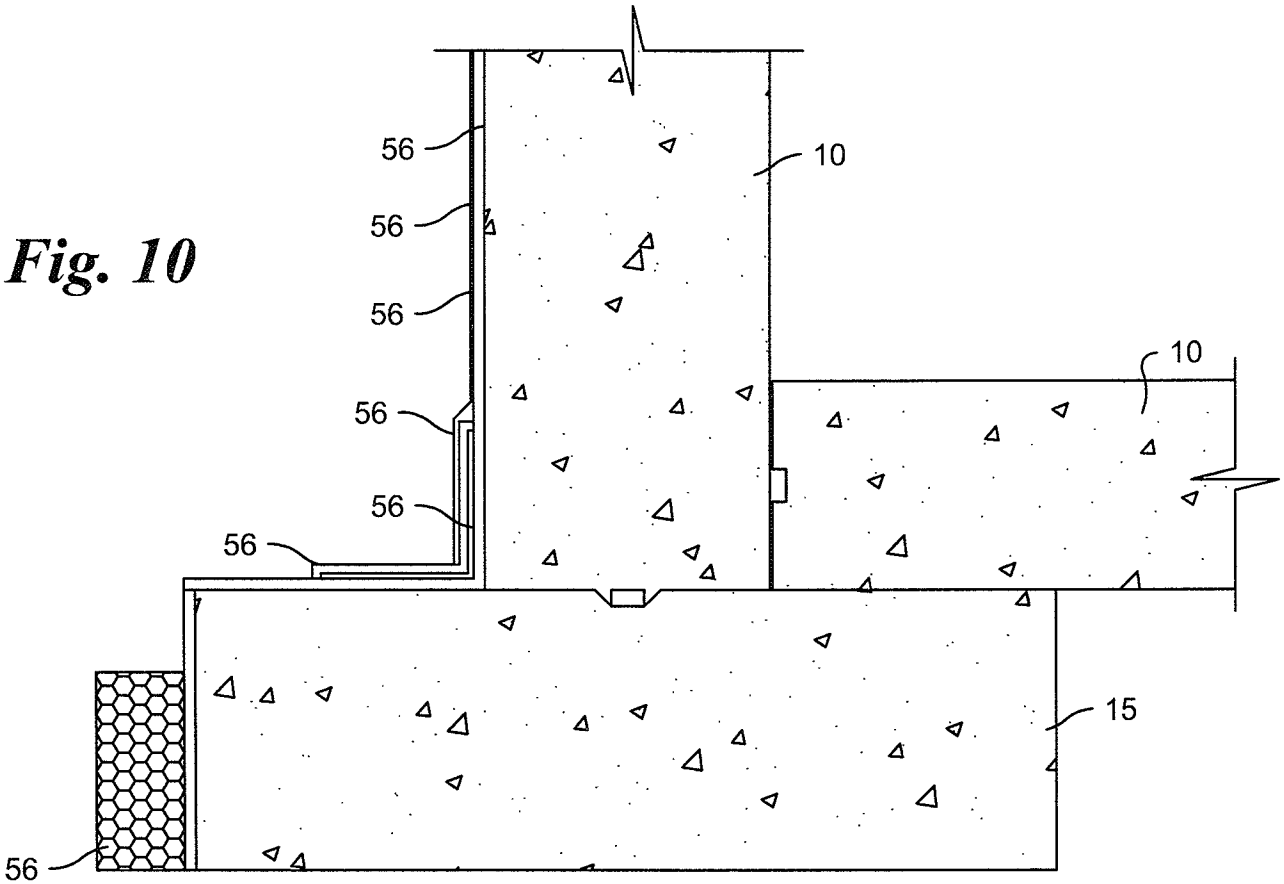
FIG. 10 is an enlarged view of a protective coating applied to an exterior joint according to a preferred embodiment of the present invention.

Referring to FIG. 10, each of the exterior-facing and interior-facing horizontal and vertical joints $J_H$ and $J_V$ of the intermediate and completed building structures 100, 200, as well as the joints between the foundation blocks 10 and the footing/foundation, are preferably provided with a protective coating. The protective coating preferably comprises one or more layers 56 of waterproof and vapor retardant/barrier materials which can adhere to the lightweight construction material that forms the building blocks 10, 12, 14, 16. Preferred examples of such materials include Polyester-160, Ecoline-R, Ecoline-S, Ecoline-T, Ecoshield-E 10, Ecodrain-E, Ecodrain-S, and Ecodrain-DS, each of which is manufactured by EPRO® Waterproofing Systems. However, it will be understood that any waterproof and vapor retardant/barrier material having similar properties may be utilized. It will also be understood that any combination and layer arrangement of one or more of these materials may be utilized. Preferably, the protective coating is subsequently covered by a rainscreen cladding (not shown). The resulting structure is substantially, and more preferably completely, waterproof.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A building system comprising:

a foundation block having opposing first and second main surfaces, a first top end and an opposing second bottom end, and opposing first and second side surfaces extending between the first and second main surfaces and between the top and bottom ends, the bottom end including a first recess and first and second base surfaces configured to contact a foundation, each of the first and second base surfaces contacting one of the first and second main surfaces of the foundation block at a right angle, portions of the first and second main surfaces proximate the top end tapering axially inwardly toward each other and toward an interior of the foundation block to form a pair of inwardly tapered surfaces and an entire remainder of the first and second main surfaces extending parallel to each other, the foundation block having a second recess formed between the pair of inwardly tapered surfaces and proximate the top end thereof; and a wall block configured to be mounted on the top end of the foundation block, the wall block having opposing first and second main surfaces, a first top end and an opposing second bottom end, and opposing first and second side surfaces extending between the first and second main surfaces and between the top and bottom ends, the bottom end including a pair of outwardly tapered surfaces which extend axially outwardly away from each other and toward an exterior of the wall block, each of the outwardly tapered surfaces contacting one of the first and second main surfaces of the wall block at an acute angle, the wall block having a first recess formed between the pair of outwardly tapered surfaces and proximate the bottom end, wherein the foundation block and the wall block are comprised substantially of a polymeric material and each further comprises a bore extending from proximate the top end thereof to proximate the bottom end thereof, each bore being generally rectangular or square in cross-section, wherein in an assembled configuration, the pair of outwardly tapered surfaces of the wall block engage the pair of inwardly tapered surfaces of the foundation block and the second recess of the foundation block mates with the first recess of the wall block to form a cavity at a joint between the wall block and the foundation block, the cavity being configured to receive and receives a metal reinforcing rod, thereby forming a first vertical stack member, and a metal reinforcing rod is received within the bore of each of the wall block and the foundation block, the bore thereafter filled with concrete.

2. The building system according to claim 1, wherein the top end of the foundation block includes a first top end portion defined by the pair of inwardly tapered surfaces and a second top end portion defined by first and second spaced-apart planar surfaces, and wherein the bottom end of the wall block includes a first bottom end portion defined by the pair of outwardly tapered surfaces and a second bottom end portion defined by first and second spaced-apart planar surfaces, the first and second spaced-apart planar surfaces of the wall block engaging the first and second spaced-apart planar surfaces of the foundation block in the assembled configuration.

3. The building system according to claim 1, wherein portions of the first and second main surfaces of the wall block proximate the top end thereof taper axially inwardly toward each other and toward an interior of the wall block to form a pair of inwardly tapered surfaces.

4. The building system according to claim 3, wherein the wall block further comprises a second recess formed between the pair of inwardly tapered surfaces and proximate the top end.

5. The building system according to claim 3, further comprising a capping block configured to be mounted on the top end of the wall block, the capping block having opposing first and second main surfaces, a first top end and an opposing second bottom end, and opposing first and second side surfaces extending between the first and second main surfaces and between the top and bottom ends, the bottom end including a pair of outwardly tapered surfaces which extend axially outwardly away from each other and toward the an exterior of the capping block.

6. The building system according to claim 1, further comprising a corner block configured to engage one of the first and second side surfaces of the wall block and one of the first and second side surfaces of the foundation block.

7. The building system according to claim 1, further comprising an adhesive applied to a horizontal joint between the foundation block and the wall block.

8. The building system according to claim 1, further comprising a second vertical stack member laterally adjoining the first vertical stack member in the assembled configuration.

9. The building system according to claim 8, further comprising an adhesive applied to a vertical joint between the first and second vertical stack members.

10. The building system according to claim 8, further comprising an adhesive applied to a horizontal joint between the foundation block and the wall block of each of the first and second vertical stack members.

11. The building system according to claim 10, further comprising one or more layers of a waterproof and vapor barrier material provided on exterior surfaces of each of the horizontal joints and on an exterior surface of the vertical joint.

12. The building system according to claim 1, wherein the first recess of the foundation block is rectangular in cross-section.

* * * * *